US008986072B2

(12) United States Patent
Darcangelo et al.

(10) Patent No.: US 8,986,072 B2
(45) Date of Patent: Mar. 24, 2015

(54) METHODS OF FINISHING AN EDGE OF A GLASS SHEET

(75) Inventors: Charles M. Darcangelo, Corning, NY (US); Aric B. Shorey, Painted Post, NY (US); Daniel D. Strong, Hector, NY (US); David A. Tammaro, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 768 days.

(21) Appl. No.: 13/116,738

(22) Filed: May 26, 2011

(65) Prior Publication Data

US 2012/0302139 A1 Nov. 29, 2012

(51) Int. Cl.

| | |
|---|---|
| ***B24B 9/08*** | (2006.01) |
| ***B24B 9/10*** | (2006.01) |
| ***B24B 21/00*** | (2006.01) |

(52) U.S. Cl.

CPC ... *B24B 9/08* (2013.01); *B24B 9/10* (2013.01); *B24B 21/002* (2013.01)

USPC ..... 451/43

(58) Field of Classification Search

CPC .... B24B 21/00; B24B 21/002; B24B 21/008; B24B 21/12

USPC ..... 451/44, 299, 303, 527, 530

See application file for complete search history.

(56) References Cited

U.S. PATENT DOCUMENTS

| | | | | |
|---|---|---|---|---|
| 1,475,741 | A * | 11/1923 | Brown | 451/305 |
| 5,616,066 | A | 4/1997 | Jacobs et al. | 451/36 |
| 6,325,704 | B1 | 12/2001 | Brown et al. | 451/44 |
| 6,910,953 | B2 * | 6/2005 | Allaire et al. | 451/44 |
| 6,991,521 | B2 | 1/2006 | Hagan et al. | 451/44 |
| 7,115,023 | B1 * | 10/2006 | Owczarz | 451/44 |
| 8,540,551 | B2 * | 9/2013 | Brown et al. | 451/44 |
| 2002/0037686 | A1 * | 3/2002 | Brown et al. | 451/42 |

(Continued)

FOREIGN PATENT DOCUMENTS

| | | | |
|---|---|---|---|
| CN | 2217015 | 1/2009 | C03B 23/02 |
| EP | 0842904 A1 | 5/1998 | |

OTHER PUBLICATIONS

S.D. Jacobs, et al., "Magnetorheological Finishing of IR Materials", SPIE, vol. 3134, pp. 258-269, Mar. 21, 2011.

(Continued)

*Primary Examiner* — Maurina Rachuba

(74) *Attorney, Agent, or Firm* — Ryan T. Hardee

(57) ABSTRACT

Methods of finishing an edge of a glass sheet comprise the step of machining the edge of the glass sheet into a predetermined cross-sectional profile along a plane taken transverse to the edge of the glass sheet with an initial average edge strength $ES_i$. The methods also include the step of finishing the edge with at least one finishing member, such as an endless belt, without substantially changing a shape of the predetermined cross-sectional profile. In one example, a wet slurry including an abrasive can be applied to at least one of a finishing member and the edge of the glass sheet. After finishing the edge, example finished average edge strengths $ES_f$ can be at least about 250 MPa. In addition or alternatively, in another example, the ratio $ES_f/ES_i$ can be within a range of from about 1.6 to about 5.6.

22 Claims, 8 Drawing Sheets

(56) References Cited

U.S. PATENT DOCUMENTS

| | | | | |
|---|---|---|---|---|
| 2005/0020193 | A1* | 1/2005 | Allaire et al. | 451/44 |
| 2008/0142480 | A1* | 6/2008 | Otsuka | 216/59 |
| 2008/0293341 | A1* | 11/2008 | Kollata et al. | 451/285 |
| 2012/0156972 | A1* | 6/2012 | Brown et al. | 451/44 |

OTHER PUBLICATIONS

N. Kobayashi, et al., "Precision treatment of silicon wafer edge utilizing ultrasonically assisted polishing technique", Journal of Materials Processing Technology, 2008, vol. 201, pp. 531-535.

I.A. Kozhinova, et al.,"Minimizing artifact formation in magnetorheological finishing of chemical vapor deposition ZnS flats", Applied Optics, Aug. 1, 2005, vol. 44, No. 22, pp. 4671-4677.

J.C. Lambropoulos, et al., "Manufacturing-induced residual stresses in optical glasses and crystals: Example of residual stress relief by magnetorheological finishing (MRF) in commercial silicon wafers", Proceedings of SPIE, 2001, vol. 4451, pp. 181-190.

D. Mohring, "Grinding, Polishing and Non Contact Metrology of PolyCrystalline Alumina Missle Domes", OptiPro Systems, Mirror Technology SBIR/STTR Workshop, Jun. 18, 2009 pp. 1-44.

J.A. Randi, et al., "Subsurface damage in some single crystalline optical materials", Applied Optics, Apr. 20, 2005, vol. 44, No. 12, pp. 2241-2249.

S.N. Shafrir, et al., "Zirconia-coated carbonyl-iron-particle based magnetorheological fluid for polishing optical glasses and ceramics", Applied Optics, Dec. 10, 2009, vol. 48, No. 35, pp. 6797-6810.

A. Shorey, et al., "Magnetorheological Finishing of large and light-weight optics", Proceedings of SPIE, vol. 5533, pp. 99-107, Mar. 21, 2011.

* cited by examiner

METHODS OF FINISHING AN EDGE OF A GLASS SHEET

FIELD

The present invention relates generally to methods of finishing an edge of a glass sheet, and more particularly, to methods of finishing an edge of a glass sheet including the step of machining the edge and then finishing the edge.

BACKGROUND

It is known to produce glass sheets for display and other applications. In order to address undesirable edge features, it is known to machine the edges of the glass sheets, for example, to reshape the edges of the glass or increase the strength of the glass sheet by reducing imperfections typically associated with the glass edges.

SUMMARY

The following presents a simplified summary of the disclosure in order to provide a basic understanding of some example aspects described in the detailed description.

In one example aspect, a method of finishing an edge of a glass sheet comprises the step of machining the edge of the glass sheet into a predetermined cross-sectional profile along a plane taken transverse to the edge of the glass sheet. The method then includes the step of finishing the edge with at least one endless belt without substantially changing a shape of the predetermined cross-sectional profile. Finishing the edge provides glass sheet with an average edge strength of at least about 250 MPa.

In another example aspect, a method of finishing an edge of a glass sheet comprises the step of machining the edge of the glass sheet into a predetermined cross-sectional profile along a plane taken transverse to the edge of the glass sheet. The method then includes the step of applying a wet slurry including an abrasive to at least one of a finishing member and the edge of the glass sheet. The abrasive includes a material selected from the group consisting of alumina and ceria. The method also includes the step of finishing the edge with the finishing member and the wet slurry.

In still another example aspect, a method of finishing an edge of a glass sheet comprises the step of machining the edge of the glass sheet into a predetermined cross-sectional profile along a plane taken transverse to the edge of the glass sheet with an initial average edge strength $ES_i$. The method then includes the step of finishing the edge with at least one finishing member without substantially changing a shape of the predetermined cross-sectional profile, wherein finishing the edge provides the glass sheet with a finished average edge strength $ES_f$, wherein the ratio $ES_f/ES_i$ is within a range of from about 1.6 to about 5.6.

BRIEF DESCRIPTION OF THE DRAWINGS

These and other features, aspects and advantages of the present disclosure are better understood when the following detailed description is read with reference to the accompanying drawings, in which.

DETAILED DESCRIPTION

Figure 1:
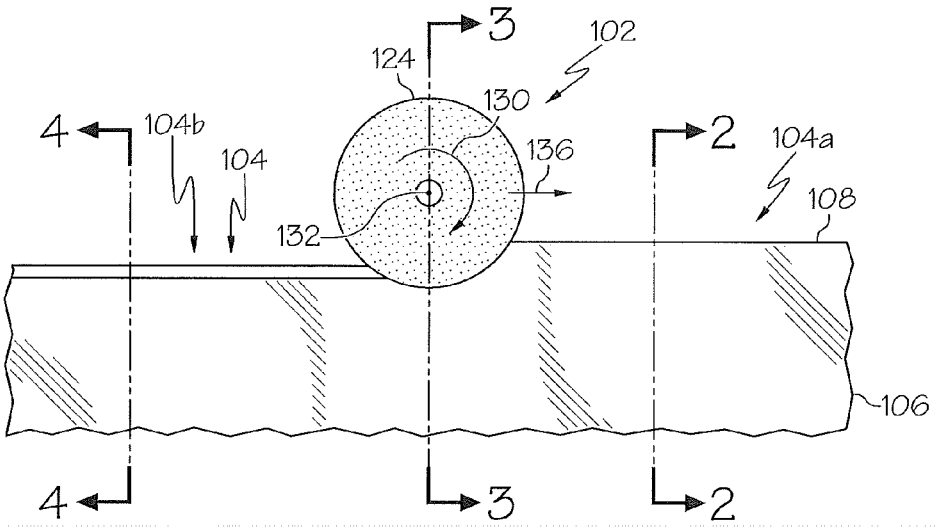
FIG. 1 illustrates and example schematic first machining device.

Methods will now be described more fully hereinafter with reference to the accompanying drawings in which example embodiments of the disclosure are shown. Whenever possible, the same reference numerals are used throughout the drawings to refer to the same or like parts. However, this disclosure may be embodied in many different forms and should not be construed as limited to the embodiments set forth herein.

Various apparatus may be used for methods of machining an edge of a glass sheet to increase the strength of the edges of the glass sheet. For the purpose of further discussion, a glass sheet, and in particular a glass sheet suitable for use in the manufacture of liquid crystal displays will be hereinafter assumed and described. However, it should be noted that the present invention has applicability to finishing the edge of other types of glass sheets.

Figure 2:
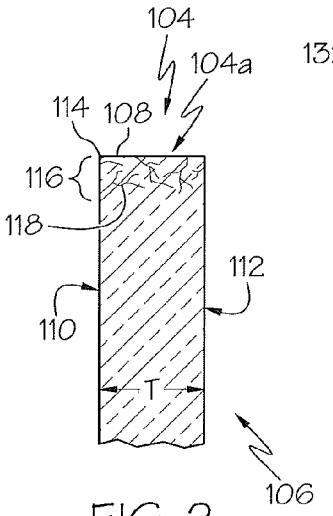
FIG. 2 illustrates a cross-sectional view of a glass sheet along line 2-2 of FIG. 1.

For example, FIG. 1 is an example schematic first machining device 102 that may be used with example methods of finishing an edge 104 of a glass sheet 106. FIG. 2 illustrates a cross-sectional view of the glass sheet 106 along line 2-2 of FIG. 1. As shown in FIG. 2, the glass can have a thickness "T"

that may comprise a wide range of values. For example, the thickness "T" of the glass sheet 106 can be less than or equal to 3 mm, such as less than or equal to 2 mm, or 1.5 mm or 0.7 mm.

As shown, line 2-2 extends along a plane taken transverse to the edge 104 of the glass sheet 106 and demonstrates an example unfinished edge profile 104*a*. The unfinished edge profile 104*a*, for example, may be formed from a glass separation process used to separate one portion of a glass member (e.g., glass ribbon) from another portion of a glass member. For instance, opposed edges of a glass ribbon may be removed to form an unfinished edge profile 104*a* that may have the shape shown in FIG. 2. In another example, the unfinished edge profile 104*a* may be formed when separating one glass sheet from another glass sheet. Various separation techniques may be used to separate one portion of a glass member from another portion of a glass member. For instance, in one example, a crack may be propagated by way of a laser and fluid cooling combination. In further examples, separation may be achieved with a score break process or other technique.

As shown in FIG. 2, the separation process can result in the flat edge 108 that may end abruptly at substantially sharp corners 114 with the first and second glass surfaces 110, 112. The sharp corners 114 and/or damaged areas 118 formed by the separation process may be included within a depth 116 of the unfinished edge profile 104*a*. The sharp corners 114 and/or damaged areas 118 can reduce the average edge strength of the glass sheet 106 since the sharp corners 114 and/or damaged areas 118 may provide stress concentrations and/or locations where cracks may form.

Figure 4:
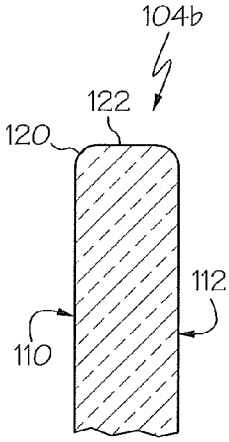
FIG. 4 illustrates a cross-sectional view of the glass sheet along line 4-4 of FIG. 1.

As such, methods of finishing the edge 104 of the glass sheet can include a process step of machining the edge 104 to provide the predetermined cross-sectional profile 104*b*. FIG. 4 illustrates a cross-sectional view of the glass sheet 106 along line 4-4 in FIG. 1. As shown, line 4-4 also extends along a plane taken transverse to the edge 104 of the glass sheet 106 and demonstrates an example of the predetermined cross-sectional profile 104*b* that may be generated by machining the edge 104 of the glass sheet 106 with the first machining device 102. In one example, the first machining device 102 can be designed to remove the sharp corners 114. Indeed, as shown in FIG. 4, the abrupt corners are replaced with rounded corners 120 that transition a flat edge 122 with the first and second glass surfaces 110, 112. As such, as shown, the predetermined cross-sectional profile 104*b* can comprise a substantially U-shaped with the illustrated rounded corners 120 and flat edge 122. Other predetermined profiles can be provided in further examples. For instance, the flat edge 122 can be rounded in some examples with a convex or concave surface. In one example, the predetermined edge profile may have a substantially U-shaped profile with the flat edge 122 comprising a convex edge extending between the rounded corners 120. Predetermined edge profiles can comprise a V-shaped profile although other profile shapes may be provided in further examples. In further examples, the predetermined profile may comprise a C-shaped profile that extends between the first and second glass surfaces 110, 112.

As discussed above, example process steps of machining the edge 104 can provide a predetermined cross-sectional profile 104*b* wherein the sharp corners 114 may be removed. In addition, or alternatively, the depth 116 of the unfinished edge profile 104*a* may be removed such that damaged areas 118 are reduced or eliminated from the vicinity of the edge 104. For example, the depth 116 may be removed wherein abrupt corners (similar to sharp corners 114) still exist while damaged areas 118 located within the depth 116 are machined away. Alternatively, as shown, the edge 104 may be machined to remove the depth 116 while also removing the sharp corners 114. As such, damaged areas 118 can be removed as well as areas of high stress concentration typically associated with relatively sharp corner such as the sharp corners 114 shown in FIG. 2. The removed depth 116 can comprise from about ⅜ mm to about ½ mm although the depth 116 may be more or less depending on the particular machining process.

Figure 3:
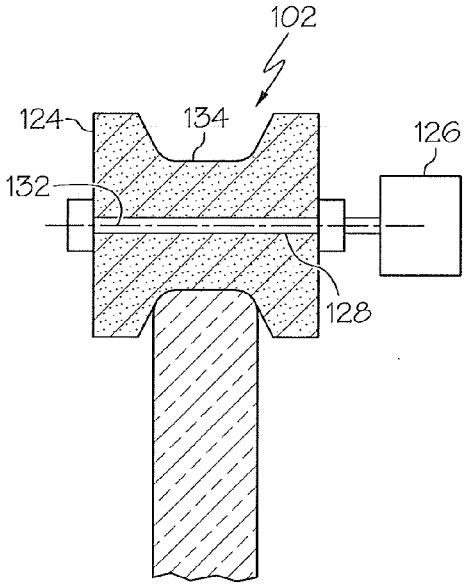
FIG. 3 illustrates a cross-sectional view of the glass sheet and a first machining device along line 3-3 of FIG. 1.

The step of machining the edge 104 of the glass sheet 106 can be carried out with a wide range of machining techniques. As shown in FIGS. 1 and 3, in one example, the step of machining can incorporate illustrated first machining device 102 comprising a rotary grinding tool although other machining devices may be provided in accordance with further examples. FIG. 3 illustrates a cross-sectional view of the glass sheet 106 along line 3-3 in FIG. 1. As shown, line 3-3 also extends along a plane taken transverse to the edge 104 of the glass sheet 106 and schematically demonstrates the example rotary grinding tool including a grinding wheel 124 and a motor 126. The motor 126 is configured to drive an axle 128 and thereby rotate the wheel either clockwise (see arrow 130) or counterclockwise along a rotation axis 132. Moreover, although not shown, the apparatus can further include a translation device configured to provide relative movement of the glass sheet 106 relative to the grinding wheel 124 in the direction 136. In one example, the grinding wheel 124 may be moved relative to a stationary glass sheet 106. In further examples, the glass sheet 106 may be moved relative to a stationary grinding wheel 124. In still further examples, both the grinding wheel 124 and the glass sheet 106 may move in the same direction or opposite directions to achieve relative movement in direction 136 of the grinding wheel 124 relative to the glass sheet 106.

The grinding wheel 124, if provided, can include a predetermined grinding profile 134 along the plane taken transverse to the edge 104 of the glass sheet 105. The predetermined grinding profile 134 is designed to have at least a portion that corresponds to the predetermined cross-sectional profile 104*b* machined into the edge 104 of the glass sheet 106.

The grinding wheel 124 may comprise a wide range of materials configured to machine the edge of the glass sheet. In one example, a 400 grit metal bonded diamond wheel may be used although other material and/or grit sizes may be used in further examples.

Machining the edge of the glass sheet into the predetermined cross-sectional profile 104*b* can substantially provide the glass sheet with an initial average edge strength $ES_i$. In applications where the initial edge is not provided by laser scoring, the initial average edge strength $ES_i$ can be substantially improved when compared to average edge strengths of glass sheets including an unfinished edge profile 104*a* that is not created with a laser scoring technique. For example, machining the edge 104 into the predetermined cross-sectional profile 104*b* can provide the glass sheet 106 with an initial average edge strength $ES_i$ in a range of from about 90 MPa to about 150 MPa measured by a four point H bend test configuration.

Figure 5:
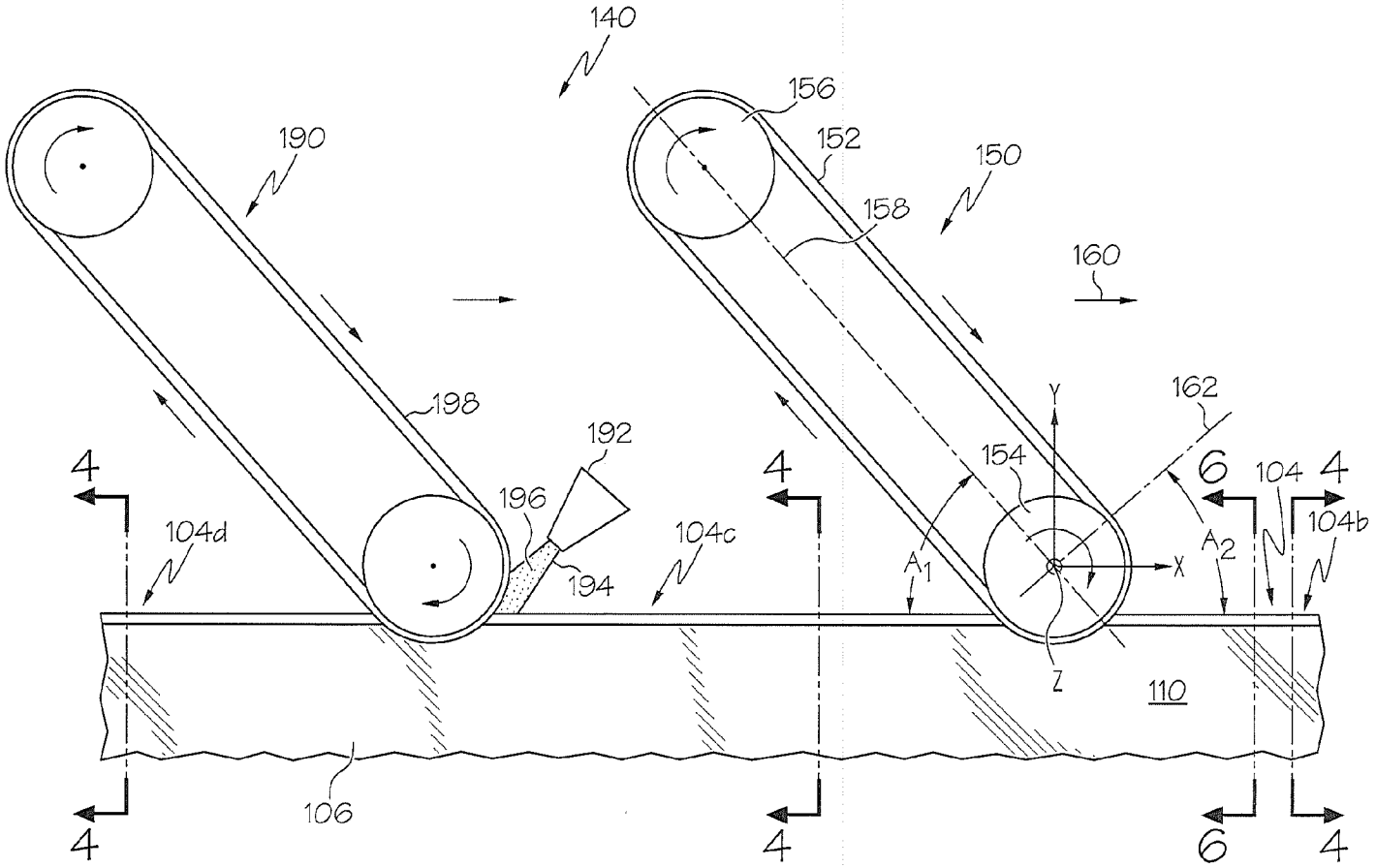
FIG. 5 illustrates an example second machining device.

As shown in FIG. 5, methods of finishing the edge 104 of the glass sheet 106 can also comprise the step of finishing the edge 104 with a second machining device 140 comprising at least one endless belt. The second machining device 140 is configured to finish the edge 104 of the glass sheet 106 without substantially changing a shape of the predetermined cross-sectional profile 104*b*. Indeed, FIG. 4 can also substantially represent the cross sections along lines 4-4 in FIG. 5. As such, the cross sections of the predetermined cross-sectional profiles 104*b*, 104*c*, 104*d* can have substantially the same shape and, as shown, may also have substantially the same size. In further examples, while the shape is not substantially changed, small removal of glass from the surface can result in minor size variations. In some examples, minor size variations can result in shapes that are geometrically similar to one another. In further examples, the shapes may be identical or substantially the same while not being geometrically similar. As such, the predetermined cross-sectional profiles 104*b*, 104*c*, 104*d* illustrated in FIG. 5 can be substantially identical to one another in size and shape. In further examples, removal of small glass portions during machining, at least one of the predetermined cross-sectional profiles 104*b*, 104*c*, 104*d* may have minor size variations and/or shape variations.

As shown in FIG. 5, the second machining device 140 can include a finishing member, such as at least one endless belt although reciprocating pads, rotating discs or other finishing members may be provided in further examples. For instance, the second machining device 140 can include a first finishing apparatus 150 including at least a first endless belt 152. The first endless belt 152, if provided, can be driven about at least two rollers 154, 156 although three or more rollers may be used in further examples.

The first finishing apparatus 150 can be located in a wide variety of positions to carry out the finishing process. In one example, the first finishing apparatus 150 can have various degrees of freedom. For example, the first finishing apparatus 150 can translate along the x-axis, y-axis, and/or z-axis. In addition or alternatively, the first finishing apparatus 150 can rotate about the x-axis, y-axis and/or z-axis. As such, the first finishing apparatus 150 can be arranged in unlimited orientations to carry out finishing techniques on the edge 104 of the glass sheet 106. In one example, the first finishing apparatus 150 can comprise an UltraForm Finishing machine available from OptiPro Systems of Ontario, N.Y.

FIG. 5 illustrated just one orientation where the first finishing apparatus 150 wherein an axis 158 of the first finishing apparatus 150 is positioned at an angle "$A_1$" relative to the edge 104 of the glass sheet 106. As shown, the Angle "$A_1$" is demonstrated as approximately 45° although other angles may be provided in further examples. For instance, as shown angle "$A_1$" is provided as an acute angle that trails the travel direction 160 of the first finishing apparatus 150. As demonstrated by alternative axis 162 of the first finishing apparatus 150, the angle "$A_2$" may comprise an acute angle that leads the travel direction 160. In still further examples, the angle "$A_1$ or $A_2$" may comprise an angle of approximately 90°. As such, it will be appreciated that the first finishing apparatus 150 may be pivoted in a wide variety or orientations relative to the Z-axis that extends in a direction transverse to the edge 104 of the glass sheet 106.

Figure 6:
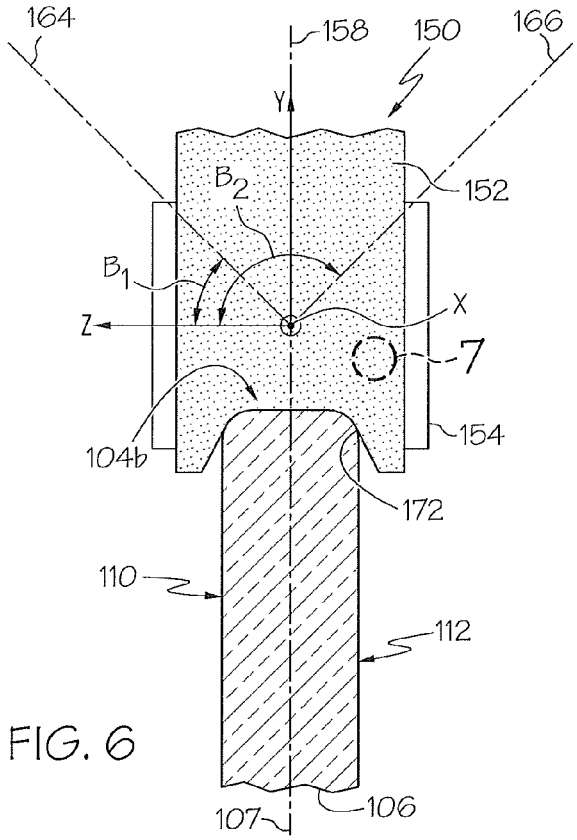
FIG. 6 illustrates a representative cross-sectional view of the glass sheet along line 6-6 of FIG. 5 also illustrating an endless belt with a U-shaped groove.

Further, FIG. 6 illustrates a representative cross-sectional view of the glass sheet 106 along line 6-6 in FIG. 5. As shown, line 6-6 also extends along a plane taken transverse to the edge 104 of the glass sheet 106 (e.g., along the illustrated Z-axis) and schematically demonstrates just one example pivot position of first finishing apparatus 150 with respect to the illustrated X-axis. Indeed, as shown, the axis 158 of the first finishing apparatus 150 can extend along a central plane 107 of the glass sheet 106. In further examples, the first finishing apparatus 150 can also be pivoted various alternative angles about the X-axis. For instance, as demonstrated by the alternative axis 164, the first finishing apparatus 150 can be pivoted at an acute angle "$B_1$" although, in further examples, the first finishing apparatus 150 can also be pivoted at an obtuse angle "$B_2$" relative to the Z-axis as shown by the further alternative axis 166 shown in FIG. 6.

Turning back to FIG. 5, the endless belt 152 can travel in a clockwise direction (as shown in FIG. 5) although a counter-clockwise rotation may be carried out in further examples. The belt can also rotate at a wide range of rotation speeds depending on the particular application, particular belt characteristics, step being performed and/or other features. For instance, the belt can rotate at a rate of about 50 rpm to about 600 rpm although other rotation speeds may be provided in further examples. Such rotation speeds can translate into a speed of the belt relative to the glass edge 104 of from about 50 cm/sec to about 1,220 cm/sec depending on the peripheral length of the endless belt. Furthermore the first finishing apparatus 150 may travel along travel direction 160 relative to the glass edge 104 at a speed of from about 25 mm/min to about 800 mm/min.

Figure 7:
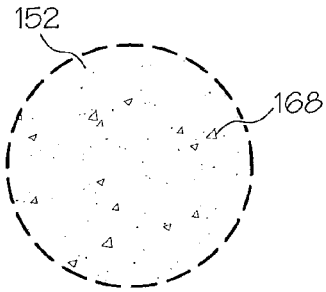
FIG. 7 illustrates a schematic enlarged view taken at view 7 of FIG. 6.

The endless belt 152 can be formed from a wide range of materials such as a polyurethane belt or other belt materials. Moreover, the belt can be provided with and/or comprise a wide range of abrasive materials for appropriate finishing of the edge 104 or an intermediate finishing of the edge 104. In one example the abrasive materials can be bonded to the belt although abrasives or slurries of abrasives may be provided separate from the belt in further examples. For instance, FIG. 7 illustrates a schematic enlarged view taken at view 7 of FIG. 6 demonstrating that any of the belts can include a diamond embedded belt including diamond particles 168 of various dimensions. In one example, the diamond particles 168 can include an average or median size of from about 1 micron to about 8 microns, such as from about 2 microns to about 5 microns, such as from about 2 microns to about 4 microns, such as about 3 microns although other size diamond particles may be used in further examples. Still further, other particle types may be used in accordance with aspects of the present disclosure.

Figure 8:
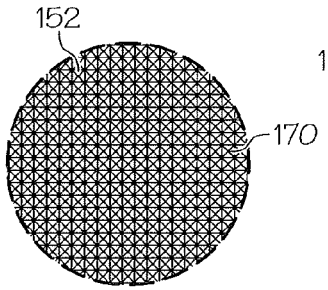
FIG. 8 illustrates a schematic enlarged view similar to FIG. 7 with a different surface characteristic.
Figure 9:
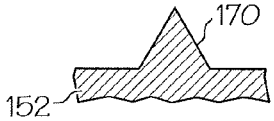
FIG. 9 illustrates an enlarged sectional view of an example micro replicated surface in the form of a square pyramid.
Figure 10:
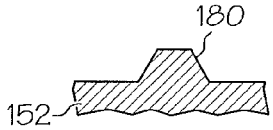
FIG. 10 illustrates yet another example micro replicated surface in the form of a truncated pyramid.

Still further, FIG. 8 illustrates a view similar to FIG. 7 wherein in addition or alternatively to particle abrasives (e.g., diamond particles), any of the belts can include a micro replicated surface 170 machined into the belts surface. Such micro-replicated surfaces can provide uniform depths of subsurface damage and potentially allow for closer control of edge failure strength, with higher strength levels. FIG. 9 illustrates on example enlarged sectional view of the micro replicated surface 170 in the form of a square pyramid although triangular pyramids, or other three dimensional surfaces may be provided in further examples. FIG. 10 illustrates yet another example of a micro replicated surface 180 that can comprise a truncated pyramid. A truncated pyramid design may allow machining without inconsistent or premature fracturing of the pyramid tips.

Figure 11:
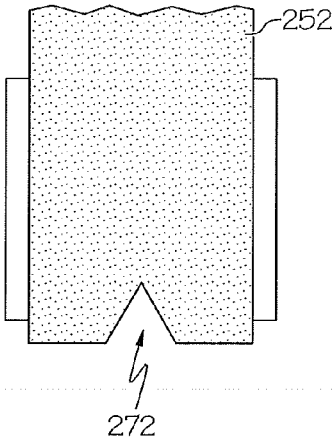
FIG. 11 illustrates another endless belt with a V-shaped groove.
Figure 12:
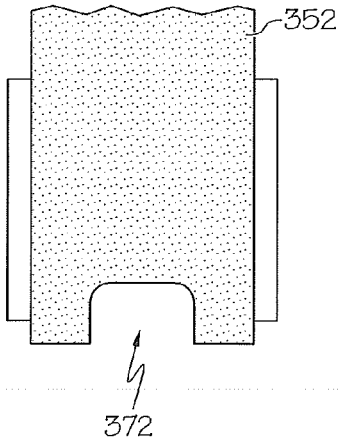
FIG. 12 illustrates another endless belt with another U-shaped groove having a C-shaped groove portion.

As shown in FIG. 6, the endless belt 152 can include a groove 172 configured to receive the edge 104 of the glass sheet 106. As shown, the groove, if provided, can be geometrically similar to the shape of the predetermined cross-sectional profile 104*b* of the edge 104 of the glass sheet 106. The groove 172 in FIG. 6 comprises a substantially U-shape although other shapes may be provided in further examples. For instance, FIGS. 11 and 12 illustrate belts 252, 352 that can be similar to endless belt 152 with alternative groove shapes. FIG. 11 shows a belt with a groove 272 including a substantially V-shape while FIG. 12 depicts a groove 372 with another substantially U-shape having a lower substantially C-shape portion.

The grooves 172, 272, 373, if provided, can be configured to engage the entire predetermined cross sectional edge profile 104*b* as illustrated in FIG. 6 although the groove may be designed to only engage a certain portion or multiple portions of the profile in further examples. For instance, the V-shaped groove 272 can be configured to engage the entire edge profile of a geometrically similar V-shaped edge profile. In alternative examples, the V-shaped groove 272 may machine the edges of a truncated V-shaped edge profile. In such examples, the chamfered edges of the V-shaped edge profile may be simultaneously finished by the V-shaped groove 272.

Figure 13:
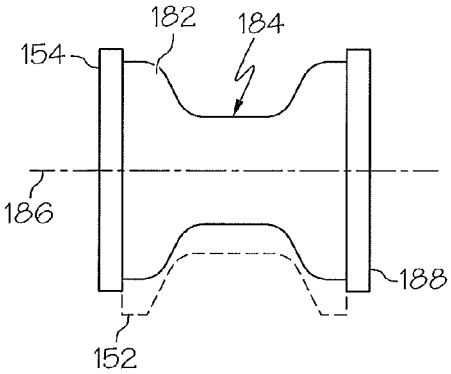
FIG. 13 illustrates an example roller.

The grooves 172, 272, 373, if provided, can be formed in a wide variety of ways. For example with reference to FIG. 13, the roller may include a sufficiently rigid core 182 with a profile 184 that may comprise the shape of the groove 172 rotated about the rotation axis 186 of the roller 154. As such, the core 182 can have an outer cylindrical surface that is symmetrically disposed about the rotation axis 186. In such examples, the endless belt 152 may conform to the shape of the profile 184 as the belt about the roller 154. As shown in FIG. 13, the roller may also include outer raised flanges 188 designed to prevent lateral shifting of the endless belt 152 off the roller 154.

In further examples, the core of the roller may be sufficiently flexible to permit at least partial deformation of the core as the roller 154 presses the endless belt 152 against the predetermined cross-sectional profile 104*b* of the glass sheet 106. For example, the roller 154 illustrated in FIG. 13 may include a core 182 that is sufficiently compliant to allow at least partial transformation of the core 182 to the shape illustrated in FIG. 13. In one example, the core includes a slight profile designed to generate a slight groove as the belt travels over the roller 154. In such examples, during finishing, the roller 154 may be pressed against the predetermined cross-sectional profiles 104*b* (with the endless belt 152 positioned therebetween) to allow the core to achieve the profile 184 shown in FIG. 13.

As will be appreciated, the core 182 of the roller 154 may have various durometers depending on the particular configuration. For example, the durometer of the core 182 can be within a range of from 0 to about 60 although rollers with other durometers may be used in further examples. In further examples, the durometer can be from about 10 to about 50, such as from about 20 to about 40 such as about 30.

Figure 14:
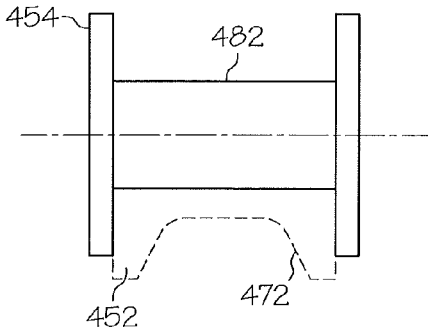
FIG. 14 illustrates another example roller.

In still further examples, the belt may be at least partially formed with a groove. For example, as shown in FIG. 14, a belt 452 may be designed with a groove 472 formed therein. In such examples, a roller 454 may comprise a core 482 that has a circular cylindrical shape or other shape that may not necessarily correspond to the shape of the groove 472 of the belt 452. In such examples, the core 482 of the roller may be substantially rigid wherein the belt 452 provides flexibility that allows the groove 472 to receive the predetermined cross-sectional profile 104*b* of the glass sheet 106.

Figure 15:
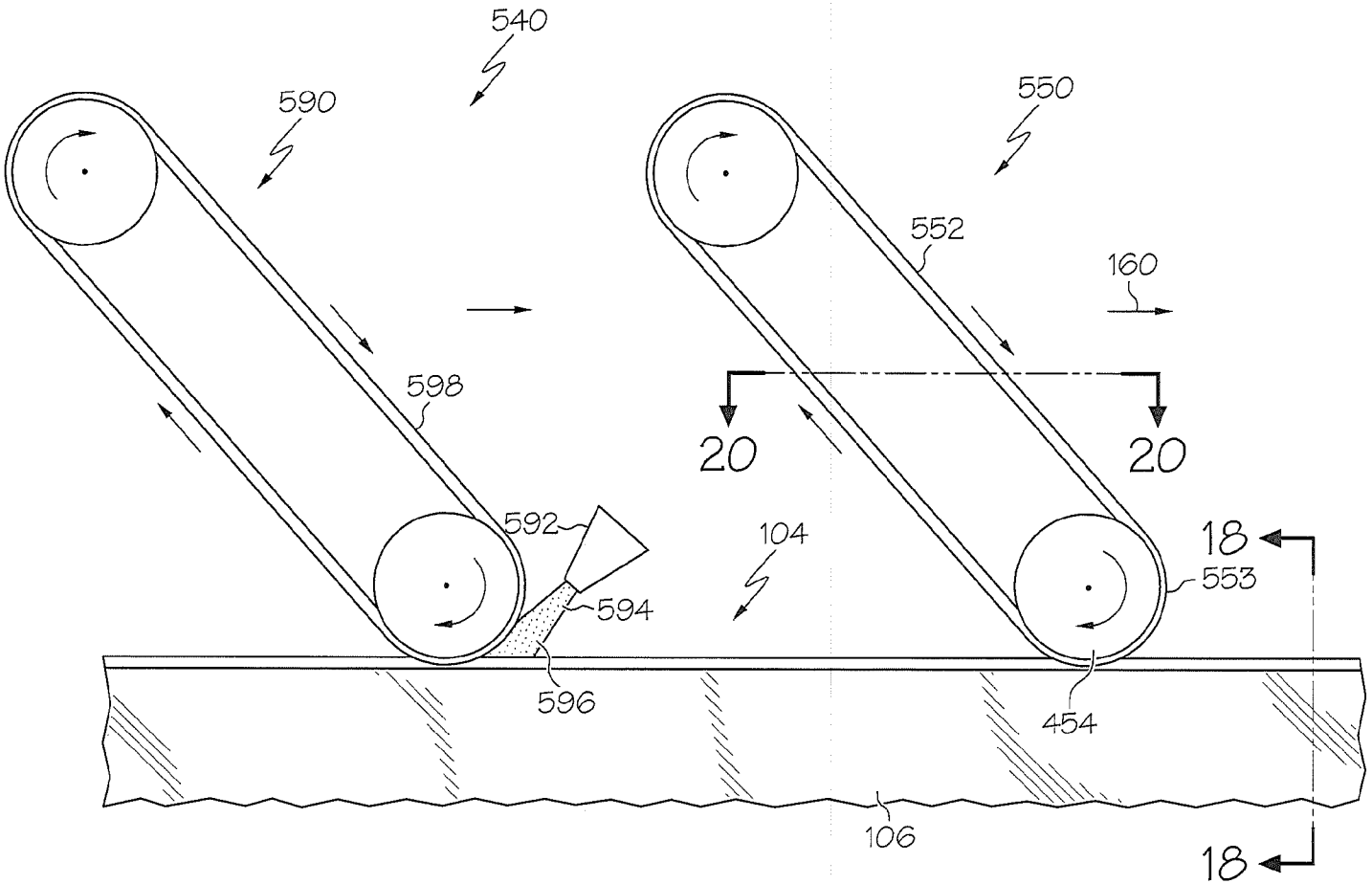
FIG. 15 illustrates another example second machining device.

FIG. 15 illustrates an alternative example of a second machining device 540 that can include another example of a first finishing apparatus 550 that may be similar or identical to the first finishing apparatus 150 described above. As shown in FIG. 5, the first finishing apparatus 150 can be designed to machine the entire predetermined cross-sectional profile 104*b* of the edge 104 in a single pass. In contrast, as shown in FIG. 15, the first finishing apparatus 550 can be designed to only machine a portion of the predetermined cross sectional profile in a single pass. In such examples, multiple passes may be provided to finish the entire edge profile.

Figure 16:
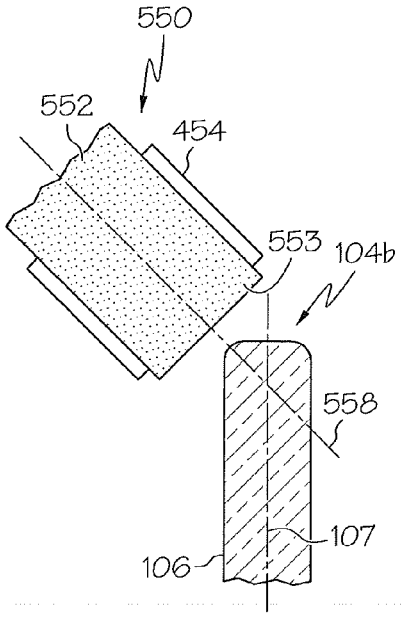
FIG. 16 illustrates the second machining device of FIG. 15 approaching a rounded corner of a predetermined cross-sectional profile of the edge of the glass sheet.

As shown in FIG. 16, in one example, the rollers 454 may have the configuration shown in FIG. 14 wherein the belt has a substantially cylindrical segment 553 without a groove although a slight groove may be provided in further examples. For instance, if the roller 454 is provided with the configuration shown in FIG. 14, the belt may be designed to be deformed to conform to a segment of the edge profile. In further examples, the roller may be similar to the roller 154 wherein the initial core profile in a noncompressed state is substantially circular cylindrical with substantially the same cylindrical radius along the axis of the roller. After compression, the roller core, having a sufficient durometer as discussed above, may conform to the shape of the corresponding portion of the profile being machined.

Turning back to FIG. 5, the second machining device 140 may also include an optional second finishing apparatus 190 that can be similar or identical to the first finishing apparatus 150. In addition or alternatively, the second finishing apparatus 190, if provided, may include a nozzle 192 configured to deliver a wet slurry 194 to apply an abrasive 196 that may comprise various abrasive types. As such, the belt may or may not include abrasive material bonded directly to the belt. Rather, a liquid slurry including abrasive 196 suspended in the slurry may be used, wherein the endless belt 198 and wet slurry 194 work together to finish the edge 104 of the glass sheet 106. In one example, the abrasive 196 can comprise ceria although alumina or other abrasive types may be provided in further examples.

The second finishing apparatus 190, if provided, may be mounted together with the first finishing device 150 to move together along the travel direction 160. In further examples, the first finishing device may be used and then subsequently followed by the second finishing device during an independent procedure wherein the first and second finishing apparatus 150, 190 are not necessarily coupled together.

The second machining device 140 can significantly improve the average edge strength of the glass sheet 106. Significant improvement of the average edge strength can be achieved in applications where the second machining device 140 only comprises the first finishing apparatus 150, or in applications where the second machining device 140 comprises both the first and second finishing apparatus 150, 190. In one example, finishing the edge 104 with the second machining device 140 after machining the predetermined profile with the first machining device 102 can provide the glass sheet 106 with a finished average edge strength $ES_f$ of at least about 250 MPa, such as about 300 MPa to about 450 MPa although other average edge strengths may be achieved in further examples.

Turning to FIG. 15, the second machining device 540 may also include an optional second finishing apparatus 590 that can be similar or identical to the first finishing apparatus 550. In addition or alternatively, the second finishing apparatus 590, if provided, may also include a nozzle 592 configured to deliver a wet slurry 594 to apply an abrasive 596 that may comprise various abrasive types. As such, the belt may or may not include abrasive material bonded directly to the belt. Rather, a liquid slurry including abrasive 596 suspended in the slurry may be used, wherein the endless belt 598 and wet slurry 594 work together to finish the edge 104 of the glass sheet 106. In one example, the abrasive 596 can comprise ceria although alumina or other abrasive types may be provided in further examples.

The second finishing apparatus 590, if provided, may be mounted together with the first finishing apparatus 550 to move together along the travel direction 160. In further examples, the first finishing device may be used and then subsequently followed by the second finishing device during an independent procedure wherein the first and second finishing apparatus 550, 560 are not necessarily coupled together.

The second machining device 540 can significantly improve the average edge strength of the glass sheet 106. Significant improvement of the average edge strength can be achieved in applications where the second machining device 540 only comprises the first finishing apparatus 550, or in applications where the second machining device 540 comprises both the first and second finishing apparatus 550, 590. In one example, finishing the edge 104 with the second machining device 540 after machining the predetermined profile with the first machining device 102 can provide the glass sheet 106 with a finished average edge strength $ES_f$ of at least about 250 MPa, such as about 300 MPa to about 450 MPa although other average edge strengths may be achieved in further examples.

Figure 22:
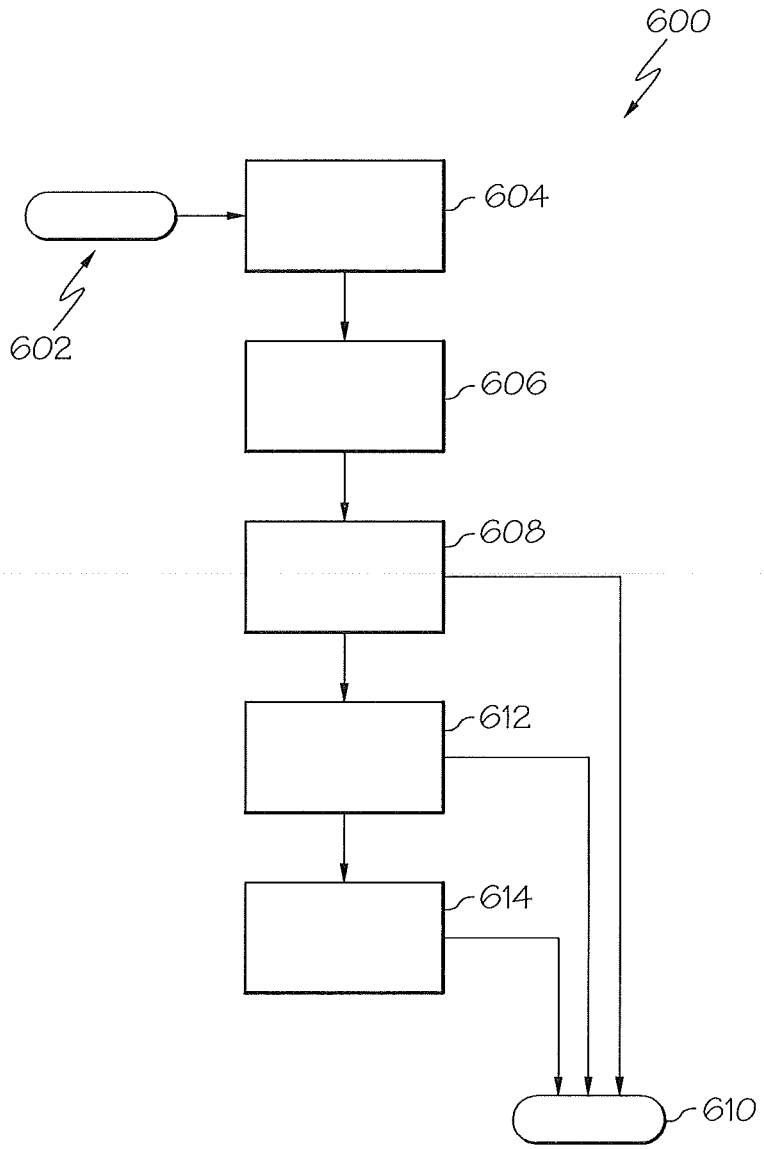
FIG. 22 illustrates a flow chart showing example methods of finishing the edge of a glass sheet.

Methods of finishing the edge 104 of the glass sheet 106 will now be described with initial reference to the flow chart 600 shown in FIG. 22. The process starts at 602, for example, beginning with step 604 of preparing and mounting the glass sheet 106 for travel with respect to the first machining device 102. The method can then include the step 606 of machining the edge 104 of the glass sheet 106 with a first machining device 102 that can comprise the illustrated rotary grinding tool. During machining, the first machining device 102 can move relative to the glass sheet 106 to achieve the predetermined cross-sectional profile 104*b* illustrated in FIG. 1. Once complete, the depth 116 of the glass sheet 106 can be removed together with the corresponding damaged areas 118. Once removed, the damaged areas and sharp corners may be removed to achieve the desired predetermined cross-sectional profile 104*b*. As shown in FIG. 4, for example, the predetermined cross-sectional profile 104*b* can be substantially U-shaped although C-shaped, V-shaped or other predetermined cross-sectional profiles may be achieved in further examples. After completing the machining technique during step 606, the predetermined cross-sectional profile 104*b* can provide the glass sheet 106 with an initial average edge strength $ES_i$ in a range of from about 90 MPa to about 150 MPa although other average strength ranges may be provided in further examples.

The method can further include the step of finishing the edge with a finishing member during step 608. In one example, the finishing member can comprise the first finishing apparatus 150 and/or the second finishing apparatus 190 illustrated in FIG. 5. For instance, the step 608 can involve machining the entire predetermined cross-sectional profile 104*b* that is received within the corresponding groove of at least one of the endless belt 152, 198 corresponding to the first and second finishing apparatus 150, 190.

Figure 17:
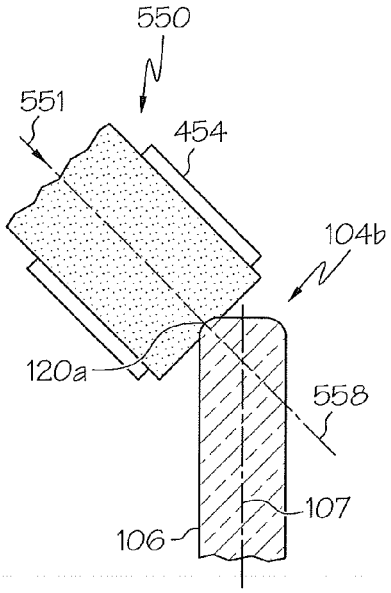
FIG. 17 illustrates the second machining device of FIG. 15 finishing a rounded corner of a predetermined cross-sectional profile of the edge of the glass sheet.

In further examples, step 608 can involve machining a portion of the predetermined cross-sectional profile 104*b* in one or more passes, for instance with at least one of the endless belts 552, 598 of the first and second finishing apparatus 550, 590. With reference to FIGS. 16-19, finishing with the first finishing apparatus 550 will be described with the understanding that finishing with the second finishing apparatus 590 can be carried out in a similar manner. Moreover, an order of machining is progressively shown from FIGS. 16-19 with the understanding that the steps may be performed in a different order in further examples. With reference to FIG. 16, the first finishing apparatus 550 can be oriented such that the axis 558 of the first finishing apparatus 550 is provided at an angle with respect to the central plane 107 of the glass sheet 106. As shown in FIG. 17, the first finishing apparatus 550 may then be translated in direction 551 along the axis 558 to compress the belt against a first rounded corner 120*a*. Due to the conformity of the roller 454 and/or the endless belts 552, the exterior of the belt can conform around the first rounded corner 120*a* of the predetermined cross-sectional profile 104*b*. The finishing process can thereby be carried out on the rounded corner 120*a* as the first finishing apparatus 550 is moved in travel direction 160 relative to the glass sheet 106 as shown in FIG. 15.

Figure 18:
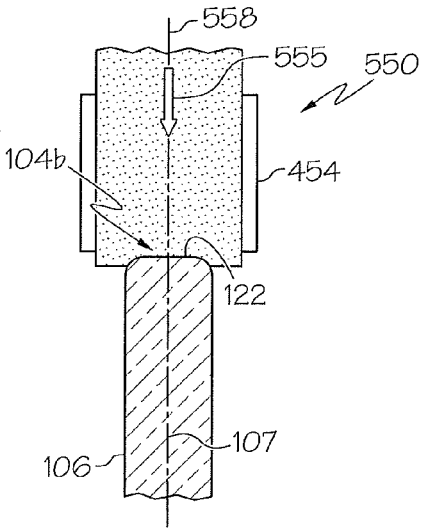
FIG. 18 illustrates a sectional view along line 18-18 of FIG. 15, demonstrating the second machining device finishing a flat edge of the predetermined cross-sectional profile of the edge of the glass sheet.

Next, as shown in FIG. 18, the first finishing apparatus 550 can be reoriented such that the axis 558 is aligned with the central plane 107 of the glass sheet 106. The first finishing apparatus 550 may then be translated in direction 555 along axis 558 to compress the belt against the flat edge 122. Due to the conformity of the roller 454 and/or the endless belts 552, the exterior of the belt can conform over the flat edge 122. The finishing process can thereby be carried out on the flat edge 122 as the first finishing apparatus 550 is moved in travel direction 160 relative to the glass sheet 106 as shown in FIG. 15.

Figure 19:
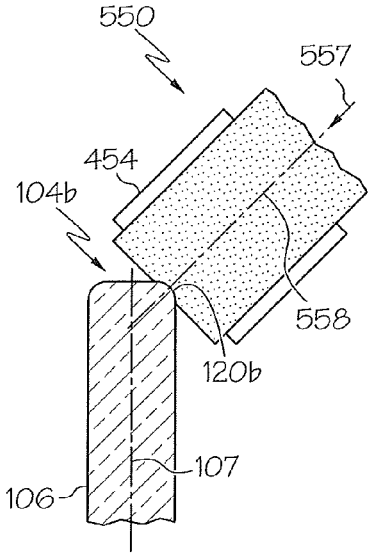
FIG. 19 illustrates the second machining device of FIG. 15 finishing another rounded corner of a predetermined cross-sectional profile of the edge of the glass sheet.

Still further, as shown in FIG. 19, the first finishing apparatus 550 can be reoriented such that the axis 558 is provided at an angle with respect to the central plane 107 of the glass sheet 106. The first finishing apparatus 550 may then be translated in direction 557 along the axis 558 to compress the belt against a second rounded corner 120*b*. Due to the conformity of the roller 454 and/or the endless belts 552, the exterior of the belt can conform around the second rounded corner 120*b*. The finishing process can thereby be carried out on the rounded corner 120*b* as the first finishing apparatus 550 is moved in travel direction 160 relative to the glass sheet 106 as shown in FIG. 15.

Figure 20:
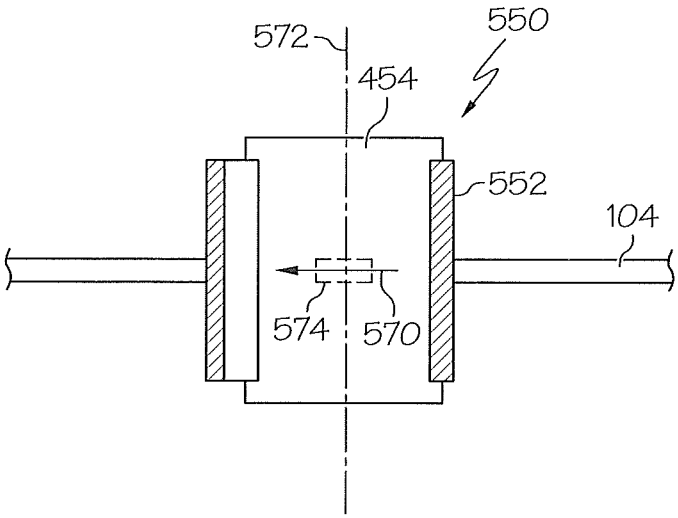
FIG. 20 illustrates a sectional view along line 20-20 of FIG. 15, demonstrating the endless belt traveling in a direction substantially parallel to the edge of the glass sheet.
Figure 21:
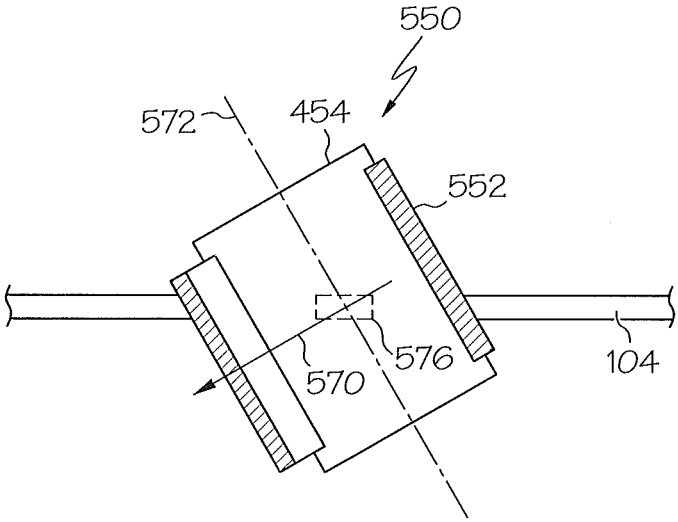
FIG. 21 illustrates a view similar to FIG. 20 but demonstrating the endless belt traveling in a direction substantially oblique to the edge of the glass sheet.

FIGS. 20 and 21 illustrate alternative orientations of the finishing apparatus 550, 590 about the Y-axis. For instance, FIG. 20 is a cross-sectional view of the first finishing apparatus 550 along line 20-20 of FIG. 15. As shown, the endless belt 552 can travel in a direction 570 substantially parallel to the edge 104 of the glass sheet 106. In such a configuration, the rotational axis 572 of the roller 454 can be substantially perpendicular to the edge 104 of the glass sheet 106. FIG. 21 illustrates an alternative orientation wherein the direction 570 of the endless belt 552 is oriented at an oblique angle with respect to the edge 104 of the glass sheet 106. The contact area 574 between the endless belts 552 and the edge 104 in FIG. 20 is smaller than the contact area 576 between the endless belts 552 and the edge 104 in FIG. 21. As such, the machining process in the orientation shown in FIG. 21 may be carried out faster when compared to the parallel orientation shown in FIG. 20. However, greater average edge strength may be achieved by machining in a parallel orientation (e.g., FIG. 20) than at an oblique angle (e.g., FIG. 21). As such, a parallel orientation may be provided in applications where a higher average edge strength is desired while an oblique orientation may be selected in applications to reduce processing time while still providing a sufficiently strong edge.

After carrying out the first finishing step 608, the finishing process may be complete as indicated by the end of the process 610. Alternatively, a second finishing step 612 may be carried out. For example, the second finishing step may be performed with one of the first finishing apparatus 150, 550 that may have similar or different abrasive belt features. In further examples, the second finishing step may be performed with the second finishing apparatus 190, 590 that can be translated along travel direction 160 in a manner similar to the first finishing apparatus. After completing the first finishing step 608 and/or the second finishing step 612, the predetermined cross-sectional profile 104*c*, 104*d* can provide the glass sheet 106 with a final average edge strength $ES_f$ in a range of at least about 250 MPa, such as about 300 MPa to about 450 MPa although other average edge strengths may be achieved in further examples.

After carrying out the second finishing step 612, the process may be complete as indicated by the end of the process 610. Alternatively, one or more further finishing techniques may be carried out during step 614 before completing the end of the process 610. In one example, a final finishing process 614 can comprise a magnetorheological finishing technique (MRF) that may provide final average edge strengths in a range from about 250 MPa to 900 GPa or more although other strength ranges may be provided in further examples.

One particular example method of finishing the edge 104 of the glass sheet 106 can comprise machining the edge 104 of the glass sheet into the predetermined cross-sectional profile 104*b* taken along the plane transverse to the edge 104 of the glass sheet 106. For example, the first machining device 102, such as the illustrated device with grinding wheel 124 can used to create the predetermined cross-sectional profile 104*b*. Then, a wet slurry including an abrasive can be applied to at least one of a finishing member and the edge 104 of the glass sheet. For instance, the abrasive can comprise alumina and/or ceria. Moreover, the finishing member can comprise an endless belt, rotating disc, reciprocating pad or other finishing member. The method can then include finishing the edge 104 with the finishing member and the wet slurry.

In another example, the method can include finishing the edge 104 of the glass sheet 105 with the step of machining the edge of the glass sheet 106 into the predetermined cross-sectional profile 104*b* along the plane taken transverse to the edge 104 of the glass sheet 106 an initial average edge strength $ES_i$. Such a process can be carried out, for example, with the first machining device 102 with the grinding wheel 124. Then the method can include finishing the edge 104 with at least one finishing member without substantially changing a shape of the predetermined cross-sectional profile. Such finishing can be carried out with a first or second finishing apparatus as described above although other techniques may be provided in further examples. Once the process is complete, the edge 104 of the glass sheet 106 can include a finished average edge strength $ES_f$, wherein the ratio $ES_f/ES_i$ is within a range of from about 1.6 to about 5.6. For instance, the initial average edge strength $ES_i$ can be within a range of from about 90 MPa to about 150 MPa and the finished average edge strength $ES_f$ can be a range of at least about 250 MPa, such as about 300 MPa to about 450 MPa.

Nonlimiting examples will now be described with experiments that are described below. Experiments were conducted using various belt configurations prepared a predetermined cross-sectional profile 104*b* with a 400 grit metal bonded diamond tooling technique. The entire machined cross sectional profile 104*b* was then finished in the following three ways (Conditions) and achieved the corresponding average edge strengths listed in the table below:

| | Condition 1 | Condition 2 | Condition 3 |
|---|---|---|---|
| | Process A | Process A<br>Process B | Process A<br>Process C |
| Time/2 edges | 2 min 18 sec | 3 min 48 sec | 6 min 48 sec |
| Avg Strength (MPa) | 244 | 255 | 414 |

Process A used a 3 micron diamond belt that was compressed against the predetermined cross-sectional profile 104*b* by 1 mm. That is, once the roller touches the surface of the predetermined cross-sectional profile 104*b*, the roller is indexed 1.0 mm into the edge to compress the roller. The belt was run at 500 rpm and was advanced at 200 mm/min.

Process B used a 0.5 micron diamond belt that was compressed against the predetermined cross-sectional profile 104*b* by 1 mm. The belt was run at 500 rpm and advanced at 400 mm/min.

Process C used a Polyurethane belt GR-25 with a $CeO_2$ slurry on the belt. The belt was compressed against the predetermined cross-sectional profile 104*b* by 1 mm. The belt was rotated at a rate of 150 rpm and advanced at 100 mm/min.

As shown, Condition 2 took substantially longer than Condition 1 while only adding a relatively small amount of average edge strength to the glass sheet. On the other hand, Condition 3 dramatically increased the average edge strength to 414 MPa when compared to Condition 1 providing an average strength of 244 MPa.

Further tests were also performed with the predetermined cross-sectional profile 104*b* first provided with a 400 grit metal bonded diamond tooling technique. The entire machined cross sectional profile 104*b* was then machined in the following six ways (#s below) and achieved the corresponding average edge strengths listed in the table below:

| # | Initial Step | Final Step | Orientation | Belt Speed (rpm) | Feed rate (mm/min) | Time/2 edges | Avg. Strength (MPa) |
|---|---|---|---|---|---|---|---|
| 1 | Step A | None | Parallel | 500 | 200 | 2 min 18 sec | 269 |
| 2 | Step A | Step B | Parallel | 500 | 150 | 5 min 54 sec | 305 |
| 3 | Step A | Step B | Perpendicular | 500 | 400 | 2 min 42 sec | 153 |
| 4 | Step A | Step C | Parallel | 400 | 150 | 5 min 54 sec | 441 |
| 5 | Step A | Step C | Parallel | 150 | 50 | 11 min 54 sec | 398 |
| 6 | Step A | Step C | Perpendicular | 500 | 200 | 3 min 54 sec | 304 |

Step A used a 3 micron diamond belt, Step B used a bound $CeO_2$ belt while Step C used a $CeO_2$ slurry on the belt. The orientation was positioned either parallel or perpendicular to the edge of the glass sheet. Notably, significant average edge strength of at least 300 MPa was achieved with Step A used in combination with Step C.

Methods of the present disclosure can be used as a potentially less expensive alternative to magnetorheological finishing (MRF) while providing sufficiently high average edge strengths. In further examples, method steps of the present disclosure may be used in conjunction with MRF to reduce cycle time. As such, the finishing techniques of the disclosure can provide much higher average edge strengths than using conventional rotary grind tools and allow for faster production of higher strength edges when compared to conventional tooling approaches. Moreover, the finishing techniques can provide an intermediate range of average edge strengths between average edge strengths typically achieved by a conventional grinding approach and an MRF technique while achieving sufficient average edge strength with less processing time. Moreover, processing time may be further increased by orienting the belt at an angle with respect to the edge of the glass sheet.

It will be apparent to those skilled in the art that various modifications and variations can be made to the present disclosure without departing from the spirit and scope of the invention. Thus, it is intended that the present invention cover the modifications and variations of this disclosure provided they come within the scope of the appended claims and their equivalents.

What is claimed is:

1. A method of finishing an edge of a glass sheet comprising the steps of:

(I) machining the edge of the glass sheet with a grinding tool into a predetermined cross-sectional profile along a plane taken transverse to the edge of the glass sheet; and then (II) finishing the edge with at least one endless belt without substantially changing a shape of the predetermined cross-sectional profile of the machined glass sheet, wherein finishing the edge provides glass sheet with an average edge strength of at least about 250 MPa.

2. The method of claim 1 wherein the average edge strength of the glass sheet is at least about 300 MPa.

3. The method of claim 2 wherein the average edge strength of the glass sheet is within a range of from about 300 MPa to about 450 MPa.

4. The method of claim 1, wherein the shape of the cross-sectional profile of the edge after step (I) is geometrically similar to the shape of the cross-sectional profile of the edge after step (II).

5. The method of claim 1, wherein, during step (II), a portion of the endless belt travels in a direction substantially parallel to the edge of the glass sheet.

6. The method of claim 1, wherein, during step (II), a portion of the endless belt travels in a direction that is at an oblique angle with respect to the edge of the glass sheet.

7. The method of claim 1, wherein, during step (II), the at least one endless belt comprises a first belt used during a first finishing step and a second belt used during a second finishing step after the first finishing step.

8. The method of claim 1, wherein, during step (II), a wet slurry is used to apply an abrasive used to finish the edge with the endless belt.

9. The method of claim 8, wherein the abrasive of the wet slurry includes a material selected from the group consisting of alumina and ceria.

10. The method of claim 1, wherein during step (II) an abrasive is bonded to the endless belt.

11. The method of claim 10, wherein the abrasive includes diamond particles.

12. The method of claim 1, wherein during step (II) a roller is used to press the endless belt against the edge.

13. The method of claim 12, wherein the roller has a durometer within a range of from 0 to about 60.

14. The method of claim 12, wherein the roller is conformable.

15. The method of claim 1, wherein the endless belt includes a groove configured to receive the edge of the glass sheet.

16. The method of claim 15, wherein the groove is geometrically similar to the shape of the predetermined cross-sectional profile of the edge of the glass sheet.

17. The method of claim 1, wherein, during step (I), a rotary grinding tool is used to achieve the predetermined cross-sectional profile.

18. The method of claim 1, wherein the predetermined cross-sectional profile produced during step (I) comprises a substantially U-shaped profile.

19. The method of claim 1, wherein machining the edge during step (I) provides the glass sheet with an average edge strength in a range of from about 90 MPa to about 150 MPa.

20. The method of claim 1, wherein the glass sheet has a thickness of less than or equal to 3 mm.

21. The method of claim 1, wherein, after step (II), further finishing the edge with a magneto rheological finishing technique.

22. A method of finishing an edge of a glass sheet comprising the steps of:

(I) machining the edge of the glass sheet with a grinding tool into a predetermined cross-sectional profile along a plane taken transverse to the edge of the glass sheet with an initial average edge strength $ES_i$; and then (II) finishing the edge with at least one finishing member without substantially changing a shape of the predetermined cross-sectional profile of the machine glass sheet, wherein finishing the edge provides the glass sheet with a finished average edge strength $ES_f$, wherein the ratio $ES_f/ES_i$ is within a range of from about 1.6 to about 5.6.

* * * * *